US005079071A

United States Patent [19]

Nagahamaya

[11] Patent Number: 5,079,071

[45] Date of Patent: Jan. 7, 1992

[54] HEAT-SENSITIVE TRANSFER MEDIUM

[75] Inventor: Yuji Nagahamaya, Takizawa, Japan

[73] Assignee: Alps Electric Co., Ltd., Tokyo, Japan

[21] Appl. No.: 398,205

[22] Filed: Aug. 24, 1989

[30] Foreign Application Priority Data

Sep. 9, 1988 [JP] Japan ..... 63-225742

[51] Int. Cl.[5] ..... B41M 5/26

[52] U.S. Cl. ..... 428/212; 428/195; 428/500; 428/913; 428/914

[58] Field of Search ..... 428/195, 212, 484, 500, 428/522, 913, 914

[56] References Cited

U.S. PATENT DOCUMENTS 4,631,232 12/1986 Ikawa et al. ..... 428/195

*Primary Examiner*—Pamela R. Schwartz

*Attorney, Agent, or Firm*—Guy W. Shoup; B. Noël Kivlin

[57] ABSTRACT

In a heat sensitive transfer medium (i.e., an ink ribbon) including a base layer, an ink layer containing a coloring agent, and an ink releasing layer interposed between the base layer and the ink layer, the present invention incorporates a heat retaining layer between the base layer and the ink releasing layer for in order to delay the dissipation of heat from the ink releasing layer. When ink has a higher resin content for the purpose of printing on rough paper, the molten ink can act as an adhesive between the paper and the ink ribbon during printing thereby causing a delay in the separation of the ink ribbon from the paper. This delay allows the ink releasing layer to cool and the molten ink to become attracted to both the paper and the ink ribbon, thus resulting in poor printing quality. The heat retaining layer suppresses the dissipation of heat from the ink releasing layer and therefore allows the ink to adhere the paper causing reliably good printing quality.

3 Claims, 2 Drawing Sheets

HEAT-SENSITIVE TRANSFER MEDIUM

BACKGROUND OF THE INVENTION

The present invention relates to a heat-sensitive transfer medium for use with a thermal transfer printer to be utilized as an output device for a word processor, computer, facsimile, etc., and more particularly to a heat-sensitive transfer medium capable of ensuring reliably good printing quality.

FIG. 2 is a schematic side view of an essential part of a thermal transfer printer in the prior art. Reference numeral 1 designates the cross-section of a platen extending longitudinally from one side of the printer to the other. A platen rubber 2 is attached on a front surface of the platen 1. A columnar support shaft 3 is disposed in front of and below the platen 1 and extends in a longitudinal direction parallel to platen 1. A carriage 4 is supported on and is movable along the support shaft 3 in the longitudinal direction parallel to platen 1. A ribbon cassette 5 containing an ink ribbon (as an example of a thermal transfer medium) is removably mounted on the carriage 4. A head mounting base 7 is rotatably supported on the support shaft 3. A thermal head 8 is supported on the head mounting base 7 which is movable together with the carriage 4 in the longitudinal direction along support shaft 3 parallel to platen 1. A guide plate 9 projects rearwardly from the head mounting base 7. The guide plate 9 is operatively engaged with a U-shaped portion 12 formed at one end of a rocking lever 11 rotatably supported on a pin 10. The rocking lever 11 is connected at its other end to a tension spring 13 for normally biasing the rocking lever 11 in a clockwise direction (as viewed in FIG. 2). Accordingly, the head mounting base 7 is normally biased by the tension spring 13 in a counterclockwise direction (as viewed in FIG. 2) via the rocking lever 11 and the guide plate 9. As a result, the thermal head 8 is normally pressed against the platen 1. A solenoid 14 is operatively connected to the rocking lever 11 in such a manner that when the solenoid 14 is energized, the rocking lever 11 is rotated in a counterclockwise direction, as viewed in FIG. 2, against the biasing force of the tension spring 13, thereby rotating the head mounting base 7 in a clockwise direction and separating the thermal head 8 and the platen 1.

FIG. 3 is a plan view of the ribbon cassette 5. The ink ribbon 6 contained in the ribbon cassette 5 is partially exposed between a ribbon outlet 5A and a ribbon inlet 5B. The ink ribbon 6 is collected on a rotating drum 15 by rotating the rotating drum 15 in a direction as depicted by the arrow shown in FIG. 3. Accordingly, the ink ribbon 6 is pulled out of the ribbon outlet 5A, and is drawn into the ribbon inlet 5B. The ribbon cassette 5 is formed with a recess 16 at a position behind the exposed portion of the ink ribbon 6. The head mounting base 7 and the thermal head 8, when the ribbon cassette 5 is mounted on the carriage 4, are disposed in the recess 16 behind the exposed portion of the ink ribbon 6.

Referring to FIGS. 4 and 5 which show a retracted positioned and an advanced position of the thermal head 8, respectively, a pair of wires 17 are connected to opposite ends of the carriage 4 to move the carriage 4 longitudinally along the support shaft 3. The carriage 4 is formed with a recess 18 for receiving the head mounting base 7. The head mounting base 7 is moved in the recess 18 such that the thermal head 8 comes into contact with and is separated from the platen 1 by the operation of the tension spring 13 and the solenoid 14.

When the solenoid 14 is deenergized, the rocking lever 11 is rotated in the clockwise direction, as viewed in FIG. 2, by the biasing force of the tension spring 13 which causes the head mounting base 7 to rotate in the counterclockwise direction. As a result, the head mounting base 7 is moved in the recess 18 from the retracted position shown in FIG. 4 to the advanced position shown in FIG. 5. In the advanced position of the head mounting base 7, the ink ribbon 6 and a printing paper 19 (see FIG. 2) are sandwiched between the thermal head 8 and the platen 1. The heating elements located in the thermal head 8 are then energized in a predetermined pattern, which depends upon, e.g., the character to be printed. As a result, the ink ribbon 6 is heated by the thermal head 8, causing the ink to be melted in the predetermined pattern. Because the ink layer 21 is pressed against the paper when it is melted, the ink is attracted to and is therefore transferred onto the paper 19, thus resulting in the transfer of, for example, a printed character from the ink ribbon 6 to paper 19.

FIG. 6 is an enlarged side view of a section of the ink ribbon 6 used as the heat-sensitive transfer medium in the prior art. As shown in FIG. 6, the ink ribbon 6 is formed by laminating an ink layer 21 onto a base layer 20. The base layer 20 is comprised of a plastic film such as polyethylene terephthalate (PETP), and the ink layer 21 is comprised of a binder primarily containing a wax such as paraffin wax and carnauba wax or a low-molecular resin such as ethylene vinylacetate copolymer (EVA) and polyamide, a coloring agent such as pigment (e.g., carbon black) and dyestuff (e.g., oil black), a softening agent such as silicone oil, a dispersing agent such as stearic acid, and antiseptics.

In recent years, there has been a demand for printers which can produce printing with reliably good quality even on rough paper, i.e., paper having a large surfaceroughness. The prior art solution to this demand is to increase the amount of resin mixed with the ink, which causes the ink to have a greater affinity for the paper. However, the resulting increase in the affinity of the ink for the paper also causes an increase in the adhesive strength between the ink layer 21 and the base layer 20. Accordingly, if the amount of resin in the ink is significantly increased, the ink layer 21 will fail to separate properly from the base layer 20 during printing. Thus, this prior art solution to the demand for reliably good printing quality on rough paper is inadequate.

To improve the quality of printing incorporating resin to increase the affinity of the ink to rough papers, there has been proposed a second solution in the form of the ink ribbon 6A shown in FIG. 7. In ink ribbon 6A an ink releasing layer 22 is interposed between the base layer 20 and the ink layer 21. The ink releasing layer 22 is composed of a wax such as amide wax (e.g., fatty acid amide) and a softening agent such as silicon oil. The wax is produced to have a melting point or a softening point not lower than that of the ink layer 21 and to have a molten viscosity lower than that of the ink layer 21.

When printing with the ink ribbon 6A, the ink releasing layer 22 is melted along with the ink layer 21 by the heat from the thermal head 8. When the ink releasing layer 22 is melted, the cohesion within the ink releasing layer becomes weak, thus allowing the ink layer 21 to be easily separated from the base layer 20 and thereby contributing to the transfer of melted ink from the ink layer 21 to the paper 19. When the ink releasing layer 22 is cooled and solidified, the cohesive strength within the wax is high and the wax adheres to both the base layer 20 and the ink layer 21. Thus, when the wax is cooled and solidified, the ink is not easily separated from the base layer 20. Accordingly, even when the amount of resin mixed in the ink layer 21 is increased, the melted ink can be smoothly transferred from the ink layer 21 to the paper 19 owing to the presence of the molten ink releasing layer 22, thereby ensuring good printing quality even on the rough paper.

However, when the amount of resin mixed in the ink is increased, it also causes delayed separation of the ink ribbon 6A from the paper 19 due to the increased adhesion between the ink and the paper. This delayed separation causes the heat (transmitted from the thermal head 8) of the molten releasing layer 22 to be dissipated too quickly and the ink releasing layer 22 to become solidified before the ink ribbon has separated from the paper. As a result, the ink releasing layer 22 cannot effectively contribute to the release of the molten ink from the ink layer 21 because the molten ink has a greater attraction for the solidified ink releasing layer 22 than for the paper 19. Therefore, the ink of the ink layer 21 cannot be reliably transferred onto the printing paper 19. That is, the ink, once having been transferred onto the printing paper 19, is transferred back to the ink ribbon 6A (which is called "inverse transfer") by the attraction between the ink and the hardened ink releasing layer 22. Inverse transfer causes deterioration of printing quality in the form of characters with missing parts or in chipping of the ink making up the printed characters. Also, the attraction of the ink to both the paper 19 and the base layer 22 causes the removal of the surface of the paper 19 when the ink is pulled from the paper by the ribbon 6A. Thus, the printing quality is greatly deteriorated.

SUMMARY OF THE INVENTION

It is an objective of the present invention to provide a heat-sensitive transfer medium, such as an ink ribbon, which can ensure reliably good printing quality from a thermal transfer printer, even when the amount of resin in the ink is increased for printing on rough paper.

The present invention provides an improvement to a heat-sensitive transfer medium which includes a base layer, an ink layer containing a coloring agent, and an ink releasing layer interposed between the base layer and the ink layer; the improvement comprising a heat retaining layer interposed between the base layer and the ink releasing layer that suppresses the dissipation of the heat from the ink releasing layer during printing.

With this improvement, even when the separation of the ink ribbon from the printing paper is delayed because an increased amount of resin is mixed with the ink of the ink layer causing increased adhesion between the ink ribbon and the paper, the proper transfer of the ink to the paper occurs because of the dissipation of heat from the ink releasing layer in a molten state can be delayed. This delay is possible because the heat is prevented from being dissipated too quickly from the molten ink releasing layer by the insulating properties of the heat retaining layer. As a result, hardening of the ink releasing layer can be suppressed. Therefore, the molten ink can be sufficiently separated from the base, thus ensuring reliable transfer of the ink onto the printing paper with reliably good printing quality.

Other objects and features of the invention will be more fully understood from the following detailed description and appended claims when taken with the accompanying drawings.

DETAILED DESCRIPTION OF THE PREFERRED EMBODIMENT

Figure 1:
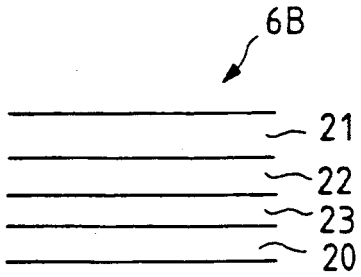
FIG. 1 is a side view of a section of the preferred embodiment of the heat-sensitive transfer medium according to the present invention.
Figure 3:
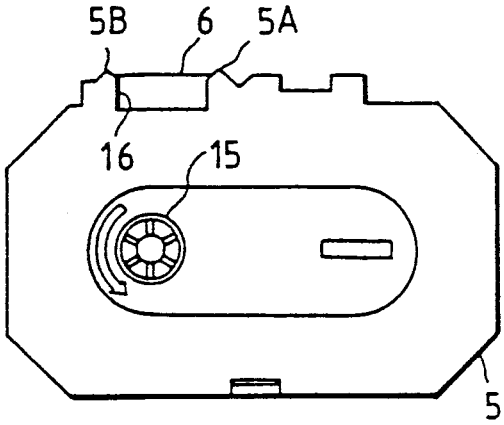
FIG. 3 is a plan view of a ribbon cassette to be used in the thermal transfer printer shown in FIG. 2.

A preferred embodiment of the present invention will now be described with reference to the drawings, wherein the reference numerals in FIGS. 2-5 designate the same elements as described in the Background section, with the exception of element 6, which now refers to the ink ribbon 6B shown in FIG. 1.

FIG. 1 shows a section of an ink ribbon 6B according to the present invention. The ink ribbon 6B includes the base layer 20, the ink releasing layer 22 and the ink layer 21, and further includes a heat retaining layer 23 interposed between the base layer 20 and the ink releasing layer 22. The heat retaining layer 23 serves to suppress the dissipation of heat from the molten ink releasing layer 22 which is melted during printing by the heat provided from the thermal head 8. The heat retaining layer 23 is formed of resin such as acrylic resin, methacrylic resin, polyacrylonitrile and polyacrylamide having a melting point higher than that of the ink layer 21 and having a heat capacity (specific heat) larger than that of the ink layer 21.

The heat retaining layer 23 is laminated on the base layer 20 in the following manner. First, the resin such as acrylic resin constituting the heat retaining layer 23 is mixed in an organic solvent such as acetone and methyl ethyl ketone (MEK) to form a colloid. The colloid is then applied onto the base layer 20 and is dried. Thus, the heat retaining layer 23 is formed on the base layer 20.

The ink releasing layer 22 is laminated on the heat retaining layer 23 in the following manner. First, the wax such as amide wax constituting the ink releasing layer 22 is heated until it is in a molten state. Then, the molten wax is applied onto the heat retaining layer 23 by coating means such as hot wire bar, hot gravure roll or hot blade.

Figure 2:
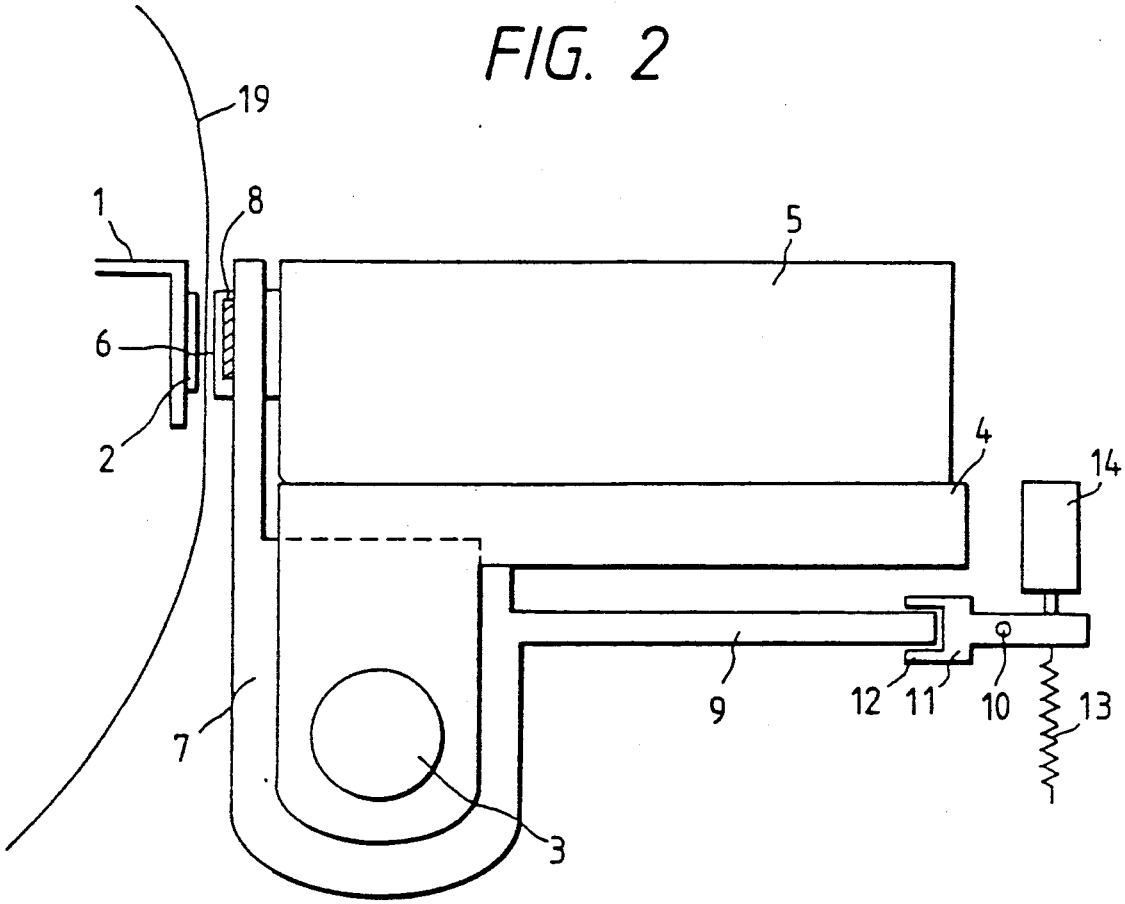
FIG. 2 is a schematic side view of a part of a thermal transfer printer in the prior art.
Figure 4:
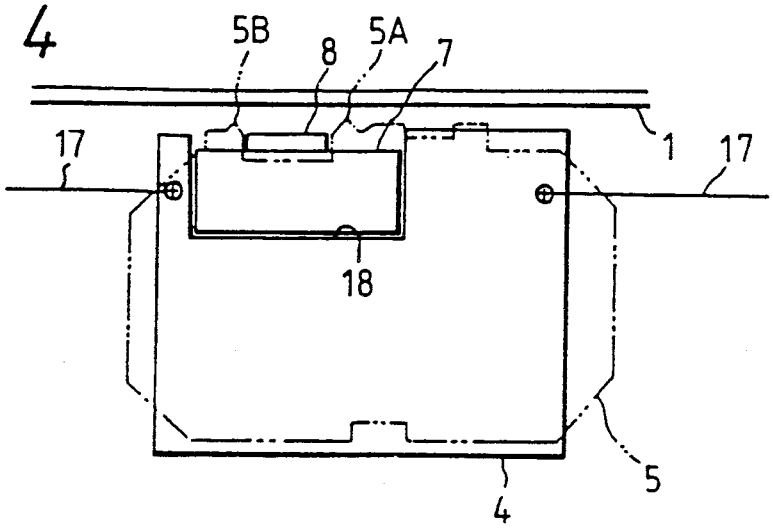
FIG. 4 is a schematic plan view of a part of the thermal transfer printer under the condition where a thermal head is in the retracted position.
Figure 5:
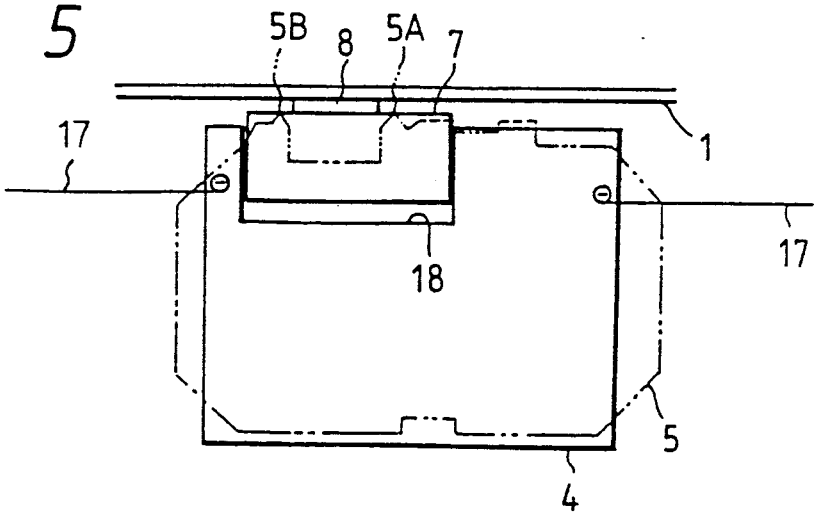
FIG. 5 is a view similar to FIG. 4, illustrating the condition where the thermal head is in the advanced position.
Figure 6:
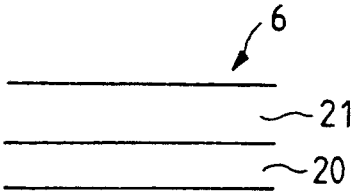
FIG. 6 PRIOR ART
FIG. 6 is a side view of a part of an example of a heat-sensitive transfer medium in the prior art.
Figure 7:
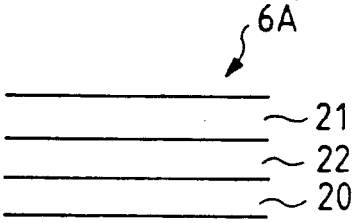
FIG. 7 PRIOR ART
FIG. 7 is a view similar to FIG. 6, illustrating another example of the heat-sensitive transfer medium in the prior art.

As shown in FIG. 2 and as described above, during the printing operation the solenoid 14 is alternately energized and deenergized, thereby rocking the head mounting base 7 between the retracted and advanced positions (shown in FIGS. 4 and 5, respectively).

When the head mounting base 7 is in the advanced position, the ink ribbon 6 and the paper 19 are sandwiched between the platen 1 and the thermal head 8 such that the base layer 20 is pressed against the thermal head 8 and the ink layer 21 is pressed against the paper 19. At this time the heating elements (not shown) located in thermal head 8 are energized in a predetermined pattern, depending upon the character to be printed. The heat generated by the heating elements heats the ribbon 6 in the predetermined pattern, thereby melting the ink releasing layer 22 and the ink layer 21. Because the molten ink releasing layer 22 develops a weak internal cohesion and a weak adhesive attraction for the ink layer 21, and because the molten ink is therefore more attracted to the paper 19 than to the base layer 20, the ink adheres to the paper 19.

When the solenoid 14 is energized, thus rotating the head mounting base 7 into the retracted position, the compression holding the ink ribbon 6 against the paper is removed and the ink ribbon 6 is pulled away from the paper leaving the molten ink on the paper 19. The compression holding the ink ribbon 6 to the paper 19 may also be removed by the carriage 4 moving along the support shaft 3, thus drawing the ink ribbon 6 into the inlet 5B and away from the paper 19.

When the amount of resin in the ink layer 21 is increased in order to facilitate printing on rough paper, the affinity of the ink for the paper is increased. Additionally, the attraction between the ink and the base layer 20 and the solidified ink releasing layer 22 is increased. Because the attraction between the molten ink and both the paper and the base layer 20 is increased, when the thermal head 8 is retracted or moved, the separation of the ink ribbon 6 from the paper 19 is delayed slightly because the ink acts as an adhesive holding the ink ribbon 6 against the paper 19. This delay allows the heat stored in the molten ink releasing layer 22 to dissipate into the base layer 20 before the paper 19 is separated from the ink ribbon 6. When the ink releasing layer 22 cools, it solidifies, thereby causing an increase in the affinity of the ink for the releasing layer 22 and, therefore, causing an increase in the adhesion between the ink layer 21 and the base layer 20. As a result, the attraction between the ink and the base layer 20 becomes greater than the attraction between the ink and the paper 19. When this occurs, the molten ink, which is in contract with and attracted to the paper 19, is drawn back onto the ink ribbon 6; this is known as "inverse transfer". When inverse transfer results, the quality of the printing decreases due to the incomplete transfer of ink to the paper; characters can be printed with missing parts, the ink making up the characters can be chipped and the surface of the paper can be torn away by the action of the ink being pulled back onto the ink ribbon 6.

However, a heat retaining layer 23 of the present invention disposed between the ink releasing layer 22 and the base layer 20 acts to insulate the molten ink retaining layer 22, thereby suppressing the dissipation of heat from the molten ink retaining layer 22. The heat retained within the ink releasing layer 22 allows the ink releasing layer 22 to remain molten long enough for the ink ribbon 6 to be separated from the paper. Because the ink ribbon 6 is separated from the paper 19 while the ink releasing layer 22 is in a molten state, the molten ink has a greater attraction for the paper 19 than for the ink ribbon 6. Thus, inverse transfer is avoided and reliable good printing quality is ensured regardless of the amount of resin mixed in the ink.

While the invention has been described with reference to a specific embodiment, the description is illustrative and is not to be construed as limiting the scope of the invention. Various modifications and changes may occur to those skilled in the art without departing from the spirit and scope of the invention as defined by the appended claims.

What is claimed is:

1. In a heat-sensitive transfer medium including a base layer, an ink layer containing a coloring agent, and an ink releasing layer interposed between said base layer and said ink layer, the improvement comprising a heat retaining layer interposed between said base layer and said ink releasing layer for the suppression of the dissipation of heat from said ink releasing layer during printing, wherein said heat retaining layer comprises a resin having a melting point higher than the melting point of said ink layer, and wherein said resin has a heat capacity larger than the heat capacity of said ink layer, and wherein said heat retaining layer is formed by mixing said resin in an organic solvent to form a colloid and then applying and drying the colloid on said base layer.

2. An improved heat-sensitive transfer medium of claim 1 wherein said ink releasing layer has a melting point not lower than the melting point of said ink layer and said ink releasing layer has a molten viscosity lower than the molten viscosity of said ink layer.

3. An improved heat-sensitive transfer medium of claim 1 wherein said heat retaining layer comprises acrylic resin.

* * * * *